US006994588B2

(12) United States Patent
Montena

(10) Patent No.: US 6,994,588 B2
(45) **Date of Patent: *Feb. 7, 2006**

(54) COMPRESSION CONNECTOR FOR COAXIAL CABLE AND METHOD OF INSTALLATION

(75) Inventor: Noah P. Montena, Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/891,818

(22) Filed: Jul. 15, 2004

(65) Prior Publication Data

US 2005/0003706 A1 Jan. 6, 2005

Related U.S. Application Data

(63) Continuation-in-part of application No. 10/309,677, filed on Dec. 4, 2002, now Pat. No. 6,780,052.

(51) Int. Cl.
*H01R 9/05* (2006.01)

(52) U.S. Cl. ..... 439/578

(58) Field of Classification Search ..... 439/578, 439/583, 584, 585

See application file for complete search history.

(56) References Cited

U.S. PATENT DOCUMENTS

| | | | | |
|---|---|---|---|---|
| 3,644,874 | A | 2/1972 | Hutter | |
| 3,673,547 | A | 6/1972 | Ziegler, Jr. | |
| 3,778,535 | A | 12/1973 | Forney, Jr. | |
| 4,131,332 | A | 12/1978 | Hogendobler et al. | |
| 4,377,320 | A | 3/1983 | Lathrop et al. | |
| 4,408,822 | A | 10/1983 | Nikitas | |
| 4,795,370 | A | 1/1989 | Freitag | |
| 5,137,471 | A | 8/1992 | Verespej et al. | |
| 5,295,864 | A | 3/1994 | Birch et al. | |
| 5,435,745 | A * | 7/1995 | Booth | 439/584 |
| 5,607,325 | A | 3/1997 | Toma | |
| 5,667,405 | A | 9/1997 | Hooliday | |
| 5,785,554 | A | 7/1998 | Ohshiro | |
| 5,857,865 | A | 1/1999 | Shimirak et al. | |
| 5,877,452 | A | 3/1999 | McConnell | |
| 5,975,951 | A | 11/1999 | Burris et al. | |
| 5,984,723 | A | 11/1999 | Wild | |
| 5,997,350 | A | 12/1999 | Burris et al. | |
| 6,089,913 | A | 7/2000 | Holliday | |
| D436,076 | S | 1/2001 | Montena | |
| 6,210,222 | B1 | 4/2001 | Langham | |
| 6,530,807 | B2 * | 3/2003 | Rodrigues et al. | 439/578 |
| 6,780,052 | B2 * | 8/2004 | Montena et al. | 439/578 |
| 2001/0034159 | A1 | 10/2001 | Pitschi | |

* cited by examiner

*Primary Examiner*—Ross Gushi
(74) *Attorney, Agent, or Firm*—Wall Marjama & Bilinski LLP

(57) ABSTRACT

A compression connector suitable for mounting upon the prepared end of a coaxial cable. The connector contains a body that defines an internal cavity made up of a main body section and a break away end section that is integrally joined to the main body section by axially extended tabs. The tabs are arranged to telescope inside the main body section when a sufficient axial force is applied to the body. A post is mounted inside the body and is arranged to pass between the inner dielectric layer and the woven mesh shield of a coaxial cable that is inserted into the body through the break away end section. The telescoped end section co-acts with the post to radially compress the cable in tight frictional engagement.

14 Claims, 9 Drawing Sheets

COMPRESSION CONNECTOR FOR COAXIAL CABLE AND METHOD OF INSTALLATION

CROSS REFERENCE TO RELATED APPLICATION

This application is a continuation-in-part of U.S. Ser. No. 10/309,677, filed Dec. 4, 2002 now U.S. Pat. No. 6,780,052.

BACKGROUND OF THE INVENTION

The present invention relates to connectors for installation on a terminal end of a coaxial cable as used, for example, in CATV applications by radial compression of the cable by a deformable body portion of the connector. More specifically, the invention relates to compression-type connectors wherein the number of parts is reduced and manner of effecting compression is different from conventional, prior art connectors of this type.

A common type of connector installed on a terminal end of a coaxial cable includes elements known as a post, a nut, a body and a compression ring. The post includes a hollow stem integrally joined at one end to a flange. The nut is rotatably secured to the post, typically at or near the junction of the stem and flange, and the body surrounds the stem with a first portion, near the nut, in frictional engagement therewith and a second portion in outwardly spaced relation thereto. The compression ring, a hollow, substantially cylindrical member, is initially maintained in engagement with the body by one end of the ring encircling the end of the body remote from the nut. The end of the coaxial cable is prepared by stripping away certain layers thereof at specified distances from the end of the central conductor. After the cable is "prepped" the connector is installed by inserting the cable axially into the connector with the stem of the connector post being forced between the outer layer of conducting material and the woven mesh metallic shielding layer. The shielding layer and the outer dielectric layer are in the initially open, annular space between the stem and inner surface of the body. Installation is completed by axial movement of the compression ring over the body with tapered surfaces on one or both of these members causing radial compression of the body into tight, frictional engagement with the outer surface of the coaxial cable.

The prior art includes, of course, a wide variety of styles and configurations of compression connectors of this general type. A feature common to radial compression connectors, however, is the separate fabrication of the body and compression ring which provide the means of frictionally engaging the connector with the cable. A variation of this design is disclosed in U.S. Pat. No. 5,525,076 of Down wherein the connector body includes one or more grooves extending into and around its outer surface. As the body is axially compressed, a portion of the body wall at the groove(s) is forced radially inwardly, into the outer dielectric layer of the coaxial cable. This forms a moisture barrier around the surface of the cable and mechanically locks the connector and cable, but does not radially compress the body into tight frictional engagement with the cable in the manner of the prior art connectors alluded to above and the present invention.

It is a principal object of the present invention to provide a novel and improved coaxial cable connector of the radial compression type which requires fewer parts than typical prior art connectors of the same general type, thereby offering advantages normally associated with a reduction in part count of multi-element devices.

It is a further object to provide a connector which is mounted to an end portion of a coaxial cable by a novel method of operation.

It is another object to provide novel and improved means for mounting a connector to the end of a coaxial cable.

Other objects will in part be obvious and will in part appear hereinafter.

SUMMARY OF THE INVENTION

In furtherance of the foregoing objects, the invention contemplates a connector having an essentially conventional post and nut in combination with a novel body. The post has the usual, integral flange and stem portions and the nut is rotatably engaged with the post at the flanged end. The hollow body includes a first portion extending axially from a first end and having an inner diameter substantially corresponding to the outer diameter of the post stem, a second portion extending axially from the first portion and having a larger inner diameter, and a third portion extending axially from the second portion to a second end. The three portions are integrally formed as a single, molded part. In a first disclosed embodiment, the third portion is connected to the second portion by a wall section of reduced thickness. The third portion is of the same inner diameter as the second portion and tapers to a larger outer diameter from the position of smallest wall thickness toward the second end of the body. When the connector is installed on the cable, the stem extends between the metal shielding layer of the cable and the outer conducting layer in the usual manner with these two layers positioned in the spaced between the outside of the stem and inside of the second body portion. When an axial force is applied (by an appropriate tool) to the third body portion, tending to move it in the direction of the first portion, the wall fractures at the section of smallest thickness, allowing the third section to be forced between the second section and the outer surface of the coaxial cable. The tapered surface on the third section is wedged between the second section and the cable surface, thereby radially compressing the cable and causing tight frictional engagement of the connector and cable.

In a second embodiment, the third section of the body has two annular areas of reduced cross section, axially spaced from one another. The thickness of these sections is such, relative to the type and characteristics of the material from which the body is fabricated, that as axial force is applied to the third section, tending to move it in the direction of the second section, that the wall folds at both areas of reduced cross section. Thus, rather than fracturing the body wall, as in the first embodiment, the body remains in a single part, but with folded layers of the third body portion between the inner surface of the second body portion and the outer surface of the cable, producing tight frictional engagement of the connector and the cable.

In a third embodiment of the invention, the body of the connector is provided with a weakened end section that is adapted to break away from the main body section and telescope inside the main body section when an axial disposed force is applied to the body. The weakened end section is attached to the main body section by a series of circumferentially spaced apart tabs that taper down from the tab root toward the main body section thereby minimizing the amount of material joining the two sections and thus the amount of axial force required to telescope the weakened end section into the main body section of the connector.

The features of the invention generally described above will be more readily apparent and fully appreciated from the following detailed description, taken in conjunction with the accompanying drawings.

DETAILED DESCRIPTION OF THE INVENTION

Figure 1:
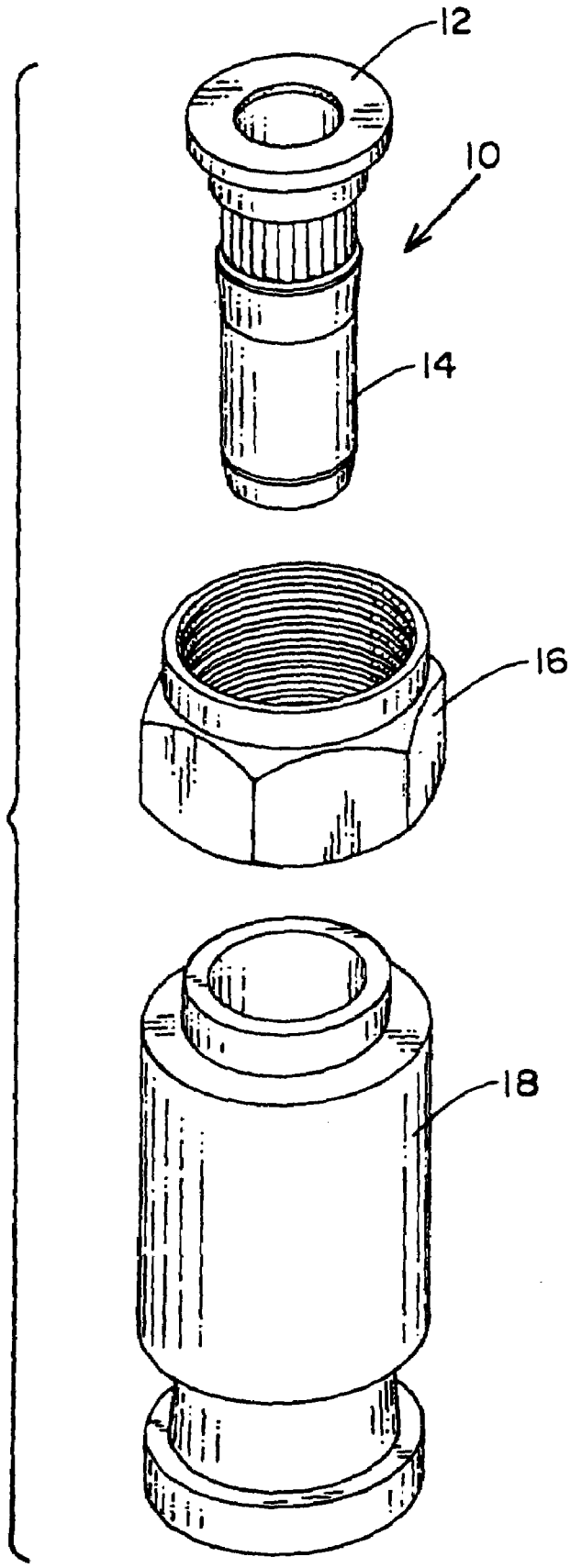
FIG. 1 is an exploded, perspective view of the cable connector of the invention, shown in a first embodiment.
Figure 2:
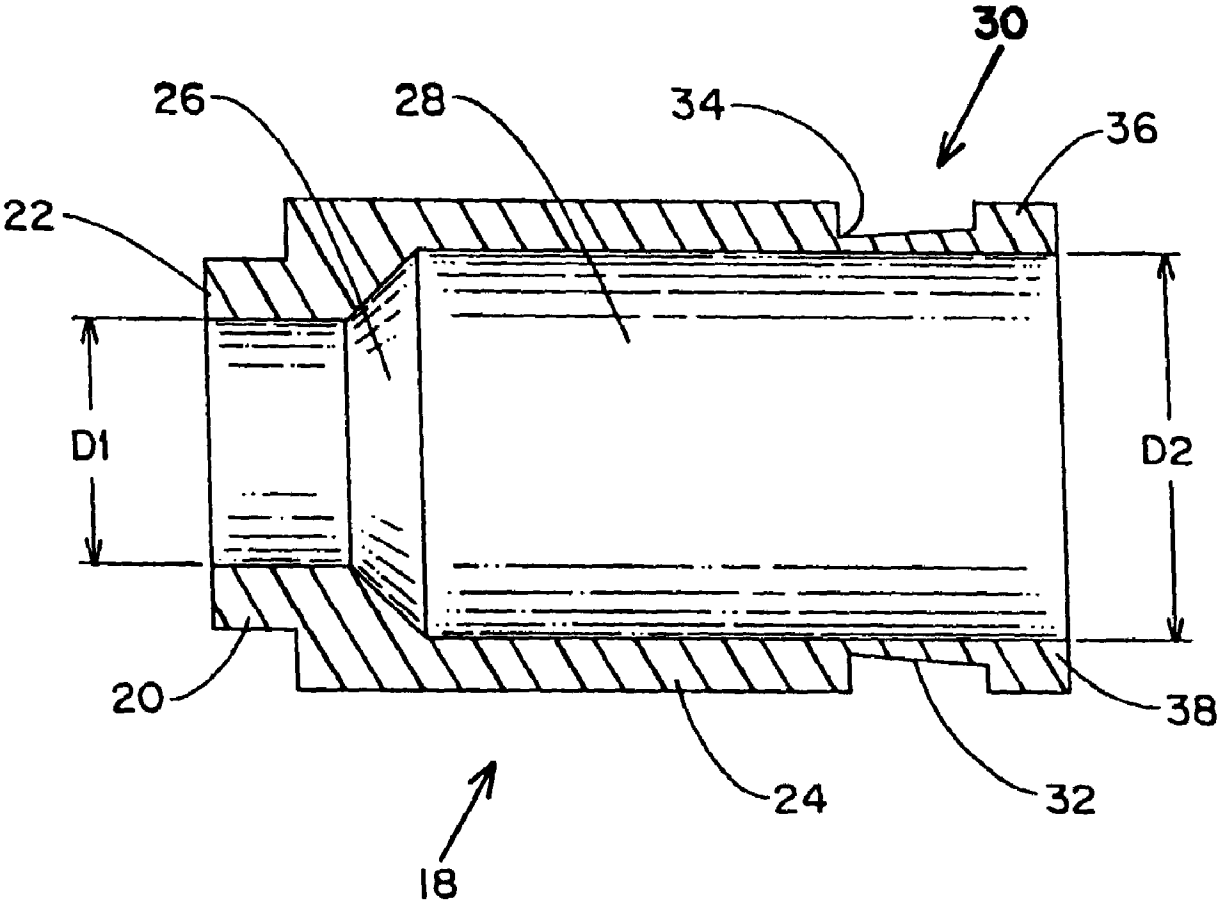
FIG. 2 is a front elevational view of one of the elements of FIG. 1 in full section.

Referring now to the drawings, in FIG. 1 are shown the three components of the connector, namely, post 10, including integrally formed flange 12 and stem 14 sections, nut 16 and body 18. Post 10 and nut 16 are of conventional construction for use in this type of coaxial cable connector, body 18 being of unique construction, shown in a first embodiment in FIGS. 1–3. Body 18 is shown in cross section in FIG. 2 where it will be noted that the body includes three sections, integrally formed as a single piece. The first section 20 extends axially from one end 22 of body 18 for a portion of its axial length having inner diameter D1. Second section 24 includes tapered portion 26, connecting inner diameter D1 with larger inner diameter D2 of constant diameter portion 28 second section 24. Third section 30 extends integrally from second section 24 with the same inner diameter, but with a wall portion 32 of reduced thickness. The smallest thickness of wall portion 32 is at its juncture with second section 24, denoted by reference numeral 34, from which the outer surface of third section 30 tapers outwardly at a relatively small angle to wall portion 36 which has the same outer diameter as second section 24 and extends to the outer end 38 of body 18. The three parts of the connector are mutually assembled by passing stem 14 through the opening defined by internal flange 17 (see FIG. 3) of nut 16, followed by passing the stem through first section 20 of body 18 until end 22 abuts larger diameter portion 15 of stem 14. Flange 17 is thus axially engaged between flange 12 of post 10 and end 22 of body 18 with nut 16 being freely rotatable with respect to post 10 and body 18.

Figure 3:
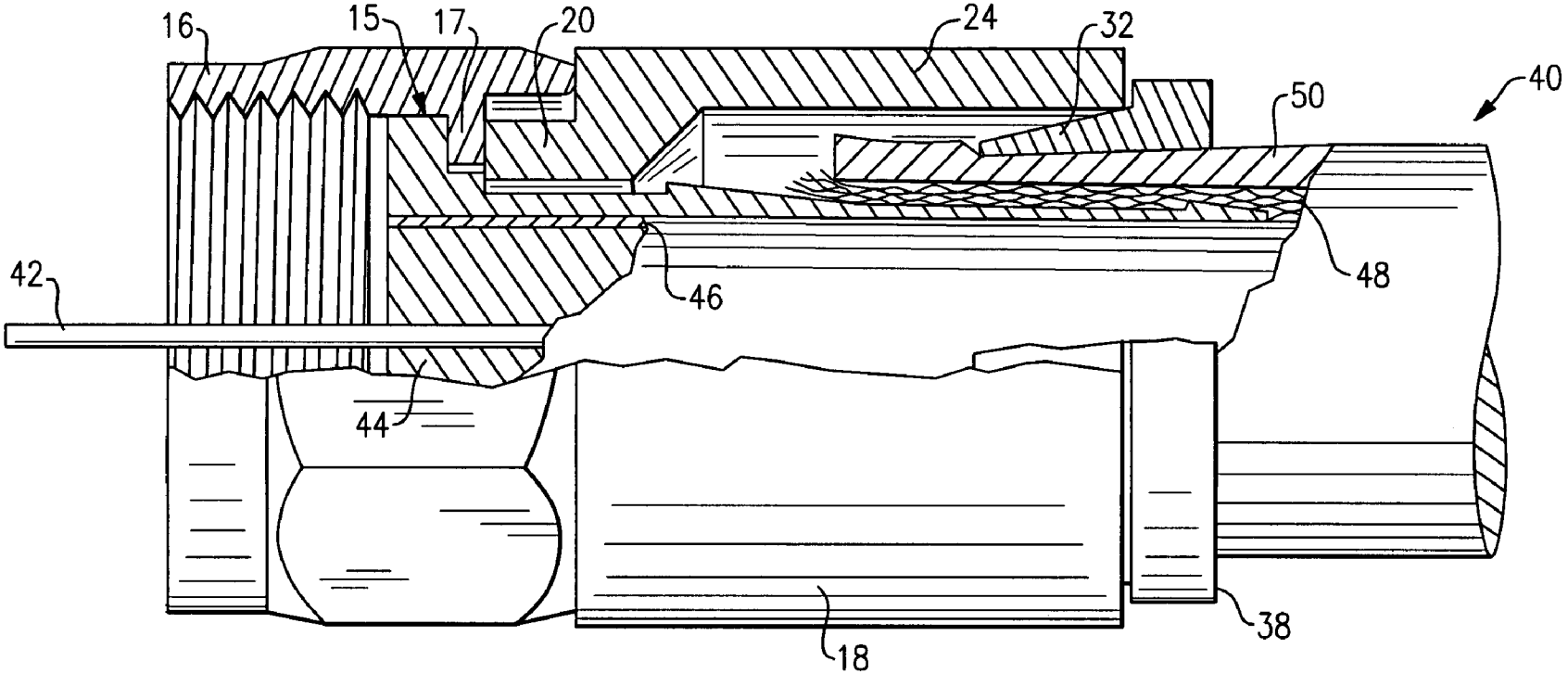
FIG. 3 is a front elevational view of the connector of FIG. 1 mounted to a conventional coaxial cable with portions of both the connector and cable broken away to be seen in section.

The connector is shown in FIG. 3 in assembled relation with an end portion of a conventional coaxial cable, denoted generally by reference numeral 40 and having inner conductor 42 surrounded by inner layer 44 of dielectric material, layer 46 of conducting material, shielding layer 48 in woven mesh form, and outer layer 50 of dielectric material. After the end of the cable has been prepped in the specified (conventional) manner, it is inserted axially into end 38 of body 18 and advanced until the exposed end surfaces of layers 44 and 46 are substantially flush with the end surface of flange 12. During this relative movement of the cable and connector, stem 14 is forcibly inserted between cable layers 46 and 48, as is also conventional in the mounting off connectors upon coaxial cables. The connector is then engaged by a compression tool (not shown) in order to apply an axial force tending to move second and third section 24 and 30 in opposite directions, i.e., toward one another. Upon application of sufficient force in this manner, body 18 fractures about its periphery at the smallest thickness of wall section 32, i.e., at the juncture of second and third sections 24 and 30, respectively, denoted in FIG. 2 by reference numeral 34. After fracturing, body 18 is in two pieces and continued application of axial force moves wall portion 32 between the inner surface of second section 24 and the outer surface of cable dielectric layer 50. The outward taper of the outer surface of wall portion 32 results in radial compression of cable 40 and tight frictional engagement of the connector and cable, as shown in FIG. 3.

Figure 4:
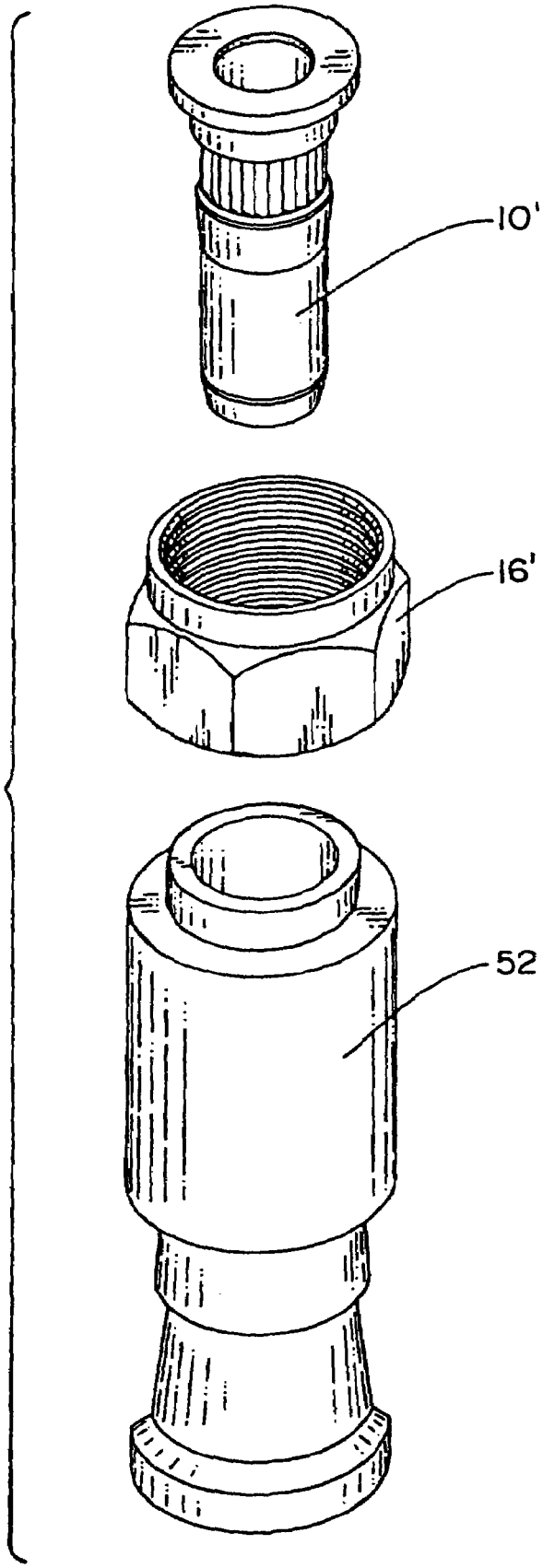
FIG. 4 is an exploded, perspective view of the cable connector of the invention, shown in a second embodiment.
Figure 5:
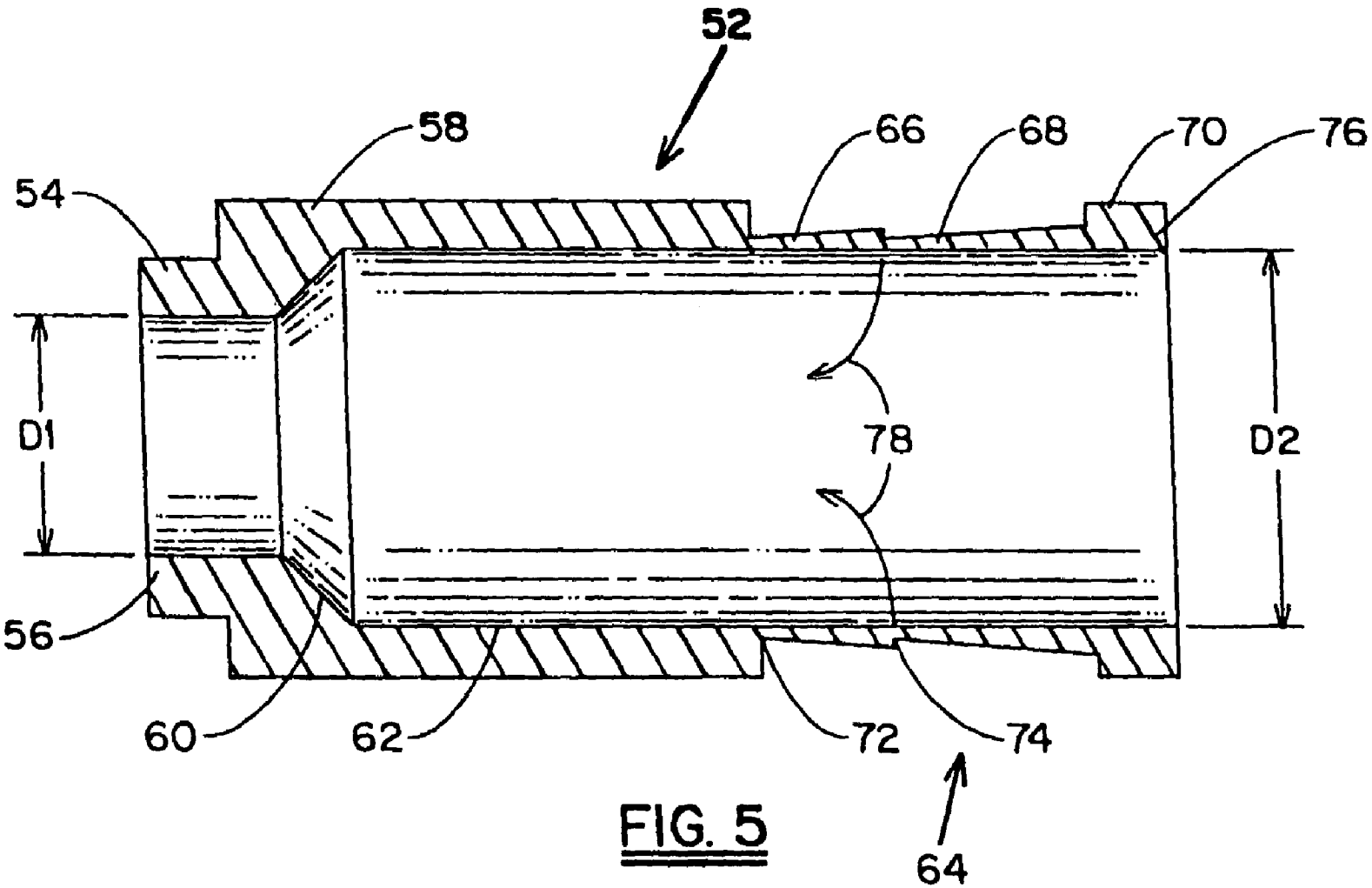
FIG. 5 is a front elevational view of one of the elements of FIG. 4 in full section.
Figure 6:
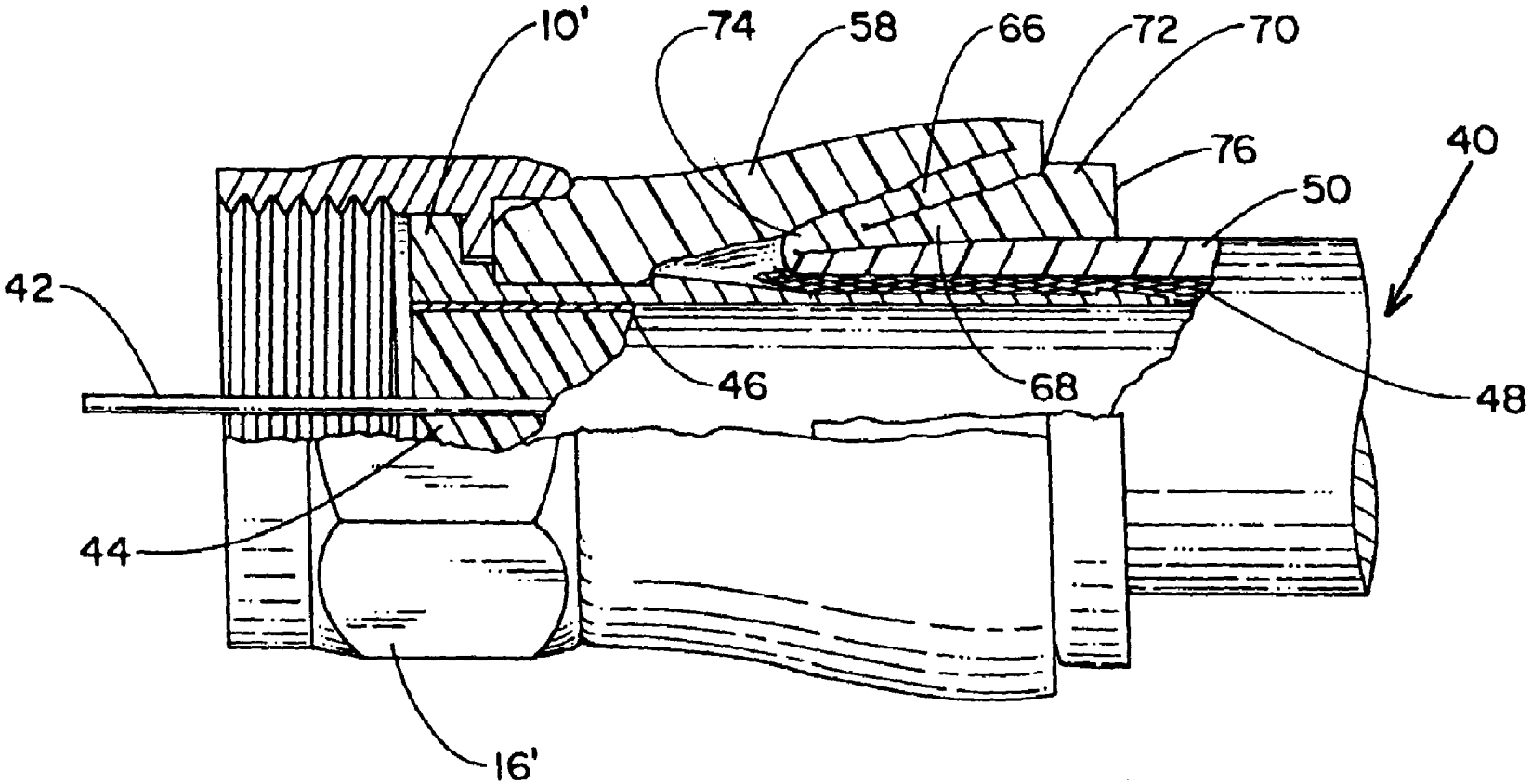
FIG. 6 is a front elevational view of the connector of FIG. 4 mounted to a conventional coaxial cable with portions of both the connector and cable broken away to be seen in section.

Turning now to FIGS. 4–6, the connector is shown with a second embodiment of the body, denoted by reference numeral 52, in combination with the conventional post and nut, here denoted by numerals 10' and 16', respectively. Body 52, as best seen in the sectional view of FIG. 5, again includes first section 54, extending from one end 56 of the body for the axial length thereof having inner diameter D1, second section 58, having tapered inner surface portion 60 connecting diameter D1 with larger inner diameter D2 of constant diameter portion 62 of second section 58. In this embodiment, third section 64 includes first, second and third wall portions 66, 68 and 70, respectively. First portion 66 extends from the junction of second and third sections 58 and 64, respectively, at a first area 72 of reduced thickness, tapering outwardly to its juncture with second portion 68 at a second area 74 of reduced thickness. Second portion 68 tapers outwardly to its junction with third portion 70 which extends to the other end 76 of body 52. Third section 64 is of constant inner diameter D2 throughout its length and is of smaller outer diameter over both portions 66 and 68 than second section 58, the outer diameter of third wall portion 70 being equal to that of second section 58.

Body 52 differs from body 18 not only in the use of an additional wall portion in the third section, but also in the material used and the manner of operation. Body 18 is preferably of a quite rigid plastic which also exhibits a degree of brittleness, whereby the material fractures at the peripheral line of smallest thickness and axial movement of the tapered portion between the second body portion and the cable radially compresses the cable with little if any outward radial movement of the body. Body 52, on the other hand, is made of a more flexible, elastic material. When axial force is applied with a compression tool, rather than fracturing, first wall portion 66 folds inwardly about the periphery of reduced thickness area 72, causing the periphery at reduced thickness area 74 to move in the direction of arrows 78. After movement of portion 66 substantially 180°, into contact with the inner surface of second section 58, wall section 68 has moved into surface-to-surface contact with wall section 66, as shown in FIG. 6 which also includes the coaxial cable with common reference numerals denoting the same parts thereof as in FIG. 3. The axial force producing the folding action of wall portions 66 and 68 is applied, of course, after the cable has been inserted into the connector. Consequently, the outer surface of the cable stands in the way of the inner movement of wall section 66, as indicated by arrows 78 in FIG. 5. The flexible nature of body 52 permits outward, flexing movement of second section 58 as inward movement of section 66 begins and inward contraction thereof as the folding is completed. The combined thickness of wall sections 66 and 68 inserted into the connector body 52 produces a tight frictional engagement of the connector to the cable. The thickness in areas 72 and 74 are established as a function of the properties of the material of body 52 to provide the desired folding action upon application of axial force tending to move third section 64 toward second section 58.

Figure 7:
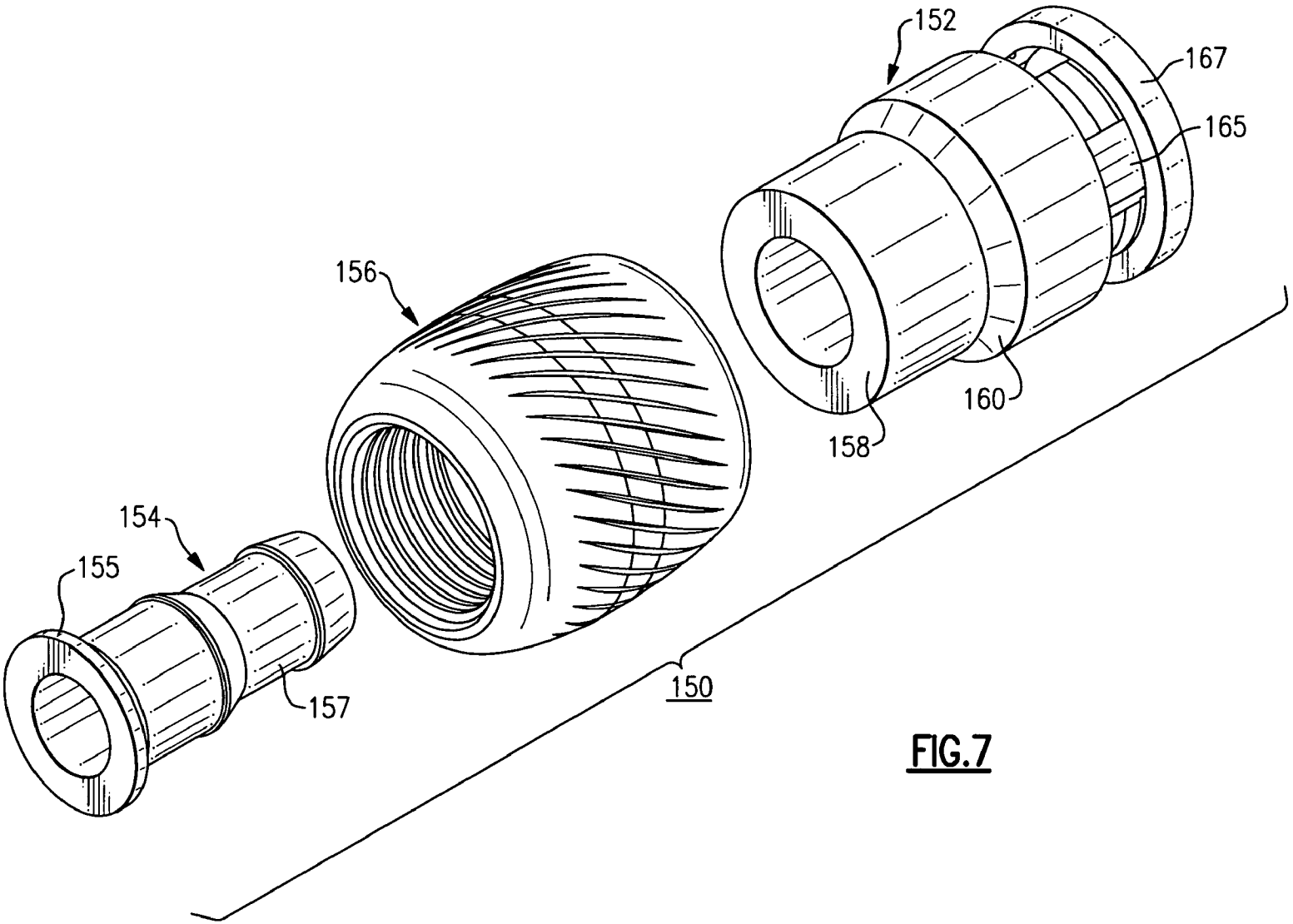
FIG. 7 is an exploded view in perspective illustrating a further embodiment of the invention.
Figure 8:
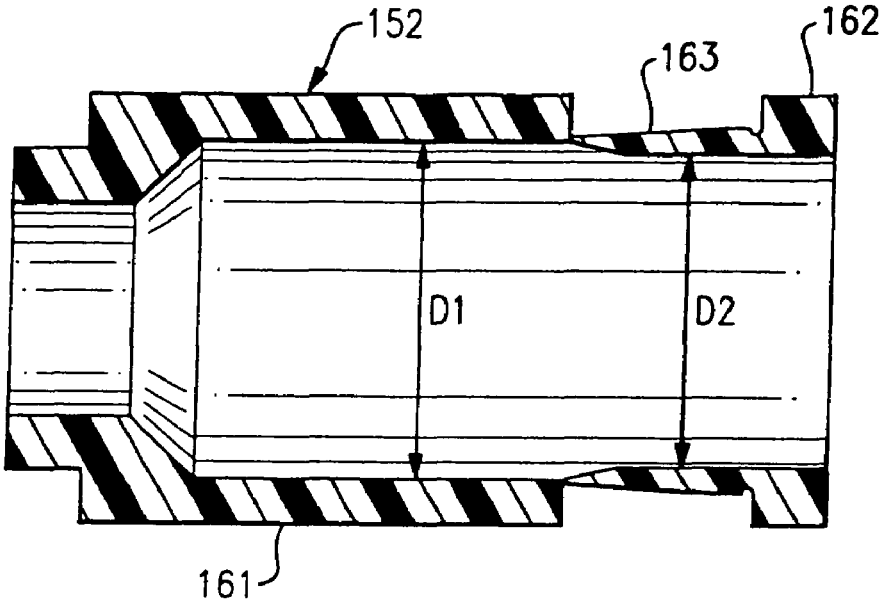
FIG. 8 is a side elevational view in section illustrating the body of the connector shown in FIG. 7.
Figure 9:
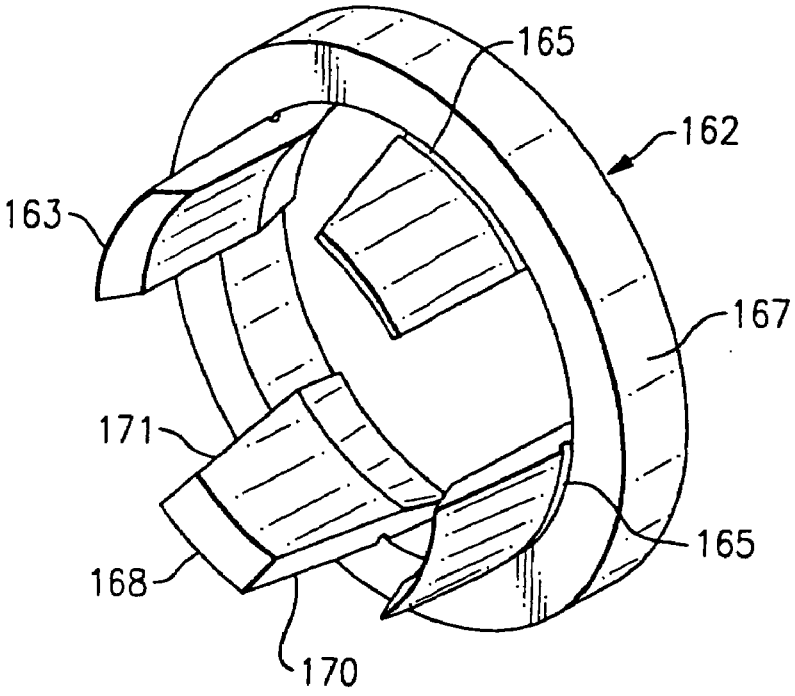
FIG. 9 is an enlarged perspective view showing the weakened end section of the body broken away from the body.
Figure 10:
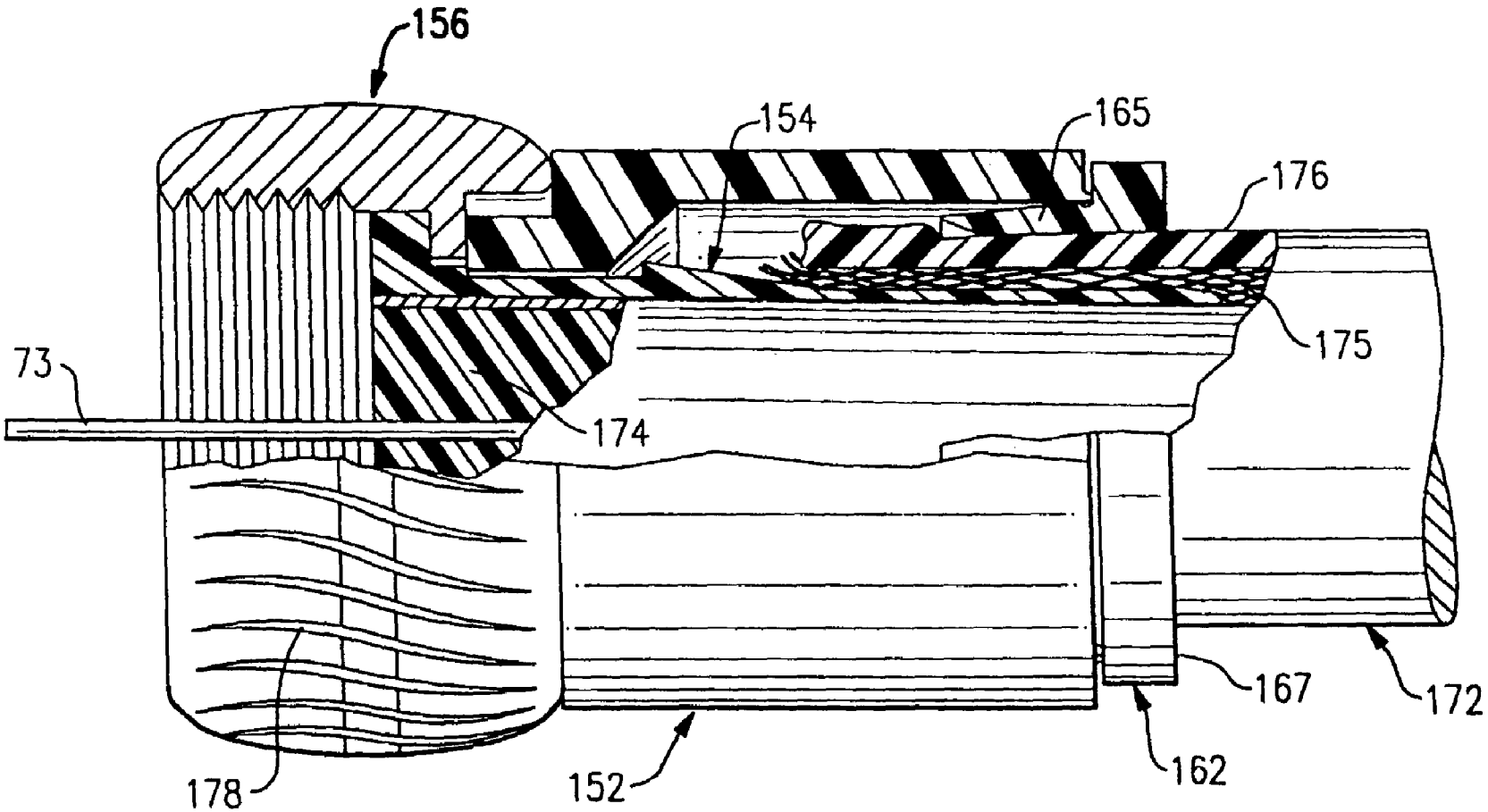
FIG. 10 is a side view in partial section of the connector shown in FIG. 7 illustrating the weakened end section telescoped inside the body.

Turning now to FIGS. 7–10 there is illustrated a further embodiment of the invention. Here again the compression connector, generally referenced 150 includes a cylindrical hollow body 152, a post 154 and an internally threaded nut 156. As best illustrated in FIGS. 7 and 10, the post, which is a hollow cylindrical member, contains a shank 157 having a flanged end 155 upon which the nut is rotatably supported in assembly. The shank of the post passes into one end 158 of the body so that the bottom of the nut is loosely seated against the raised shoulder 60 of the body.

The body 152 of the connector includes a main body section 161 and a weakened end section 162. The weakened body section is integrally joined to the main body section by a series of break away tabs 163–163. The tabs are circumferentially spaced about the body so as to support the weakened end section in axial alignment with the main body section. Each tab has a root 165 that is joined to a ring shaped end wall 167 of the end section. The cross section of each tab preferably decreases uniformly as the tab extends toward the main body section so that the joint between the end section and the main body section, although strong enough to support the end section in axial alignment with the main body section, can be easily broken away from the main body section when an axial load is applied to the body section.

As best illustrated in FIG. 8, the inside diameter D1 of the main body section is slightly greater than the diameter D2 of the weakened end section. The tips of the tabs are also provided with a wedge configuration which combines with the reduced inside diameter to insure that the weakened end section will move into telescoping relationship with the main body section when a sufficient axial force is applied to the body to cause the tabs to separate from the main body section.

FIG. 9 shows the weakened end section removed from the main body section. In this embodiment, each tab tapers from its root 165 toward its terminal end 168 where the tab joins the main body section. The side walls 170 and 171 of each tab can also be tapered inwardly toward each other from the tab root toward the terminal end of the tab so that a relatively strong joint is established at the ring shaped end wall 167 while the joint that is formed at the tip end of each tab at the main body section is considerably weaker insuring that failure will occur at the tip of the tabs.

The connector is shown in FIG. 10 assembled with an end portion of a conventional coaxial cable generally referenced 172. The cable has a center conductor 73 that is surrounded by a dielectric material 174 which may or may not be covered by a conductive foil. A wire mesh shield 175 is placed over the dielectric layer which in turn is surrounded by a protective outer jacket 176. Prior to insertion into the connector the cable is prepared by rolling back the outer jacket and the wire mesh shield to expose the dielectric layer. The end portion of the dielectric layer is cut away to expose a length of the center conductor.

In assembly the prepared end of the cable is inserted into the weakened end of the connector so that the post passes between the dielectric layer and the mesh shield of the cable. An axial force is then applied to the body to break away the weakened end section and telescope the end section inside the main body section. The telescoped portion of the weakened end section exerts a compressive force upon the cable to tightly engage the cable between the telescoped portion of the end section and the hollow post thus locking the cable to the connector.

In this embodiment of the invention, the threaded nut which is rotatably supported upon the flanged end of the post is an annular shaped member that is adapted to be hand tightened to a male connection. To facilitate hand tightening of the nut, the outer surface of the nut is provided with a textured surface having shallow contoured grooves 178 which enable a tight non-slip hand grip to be secured upon the nut.

While the present invention has been particularly shown and described with reference to the preferred mode as illustrated in the drawing, it will be understood by one skilled in the art that various changes in detail may be effected therein without departing from the spirit and scope of the invention as defined by the claims.

I claim:

1. A compression connector for mounting upon the end of a coaxial cable that has a center conductor, an inner layer of dielectric material, a woven mesh shield surrounding the dielectric layer and an outer protective jacket, wherein said connector includes:

a body defining an internal cavity, said body having a weakened end section which is integrally joined to a main body section by spaced apart tabs said tabs having tab roots adjoining the weakened end section such that the tabs of the weakened end section will break away from the main body section and become telescoped inside the main body section when an axial force is applied to the body;

a post mounted inside said body, said post having a stem configured to pass between the dielectric layer and the woven mesh shield of a coaxial cable that is inserted into the body through the weakened end section; and said post being arranged to co-act with the telescoped weakened end section of the body to radially compress the protective jacket of the cable in tight frictional engagement between the post and the telescoped weakened end section of the body when an axial force is applied to said body that is sufficient to telescope the weakened end section inside said body.

2. The connector of claim 1 wherein the said body is cylindrical.

3. The connector of claim 2 wherein each tab tapers downwardly in a radial direction from the tab root toward the main body section.

4. The connector of claim 2 wherein each tab contains a pair of side walls that slope inwardly towards each other as the tab extends outwardly from the tab root toward the main body section.

5. The connector of claim 2 wherein each tab tapers downwardly in a radial direction from the tab root toward the main body section, each tab further including a pair of side walls that taper inwardly toward each other from the tab root toward the main body section.

6. The connector of claim 2 wherein the main body section has a first inside diameter and the weakened end section has a second inside diameter wherein said first inside diameter is greater than said second inside diameter.

7. The connector of claim 1 wherein said post includes an external flange adapted to rotatably mount a threaded nut onto the post.

8. The connector of claim 7 wherein said nut has a textured outer surface to facilitate hand tightening of said nut.

9. A method for mounting a connector to the prepared end of a coaxial cable having a center conductor, an inner dielectric layer, a woven mesh shield surrounding the dielectric layer and an outer protective jacket, said method including the steps of:

providing a body that defines an inside cavity, said body having a weakened end section of a first inside diameter and a main body section of a second inside diameter;

joining the weakened end section to a main body section by integral tabs having a cross sectional area so that the weakened end section of the body will telescope inside the main body section when an axial force is applied to the body;

mounting a hollow post inside the body so that the post is axially aligned with the body;

inserting a prepared end of a coaxial cable into the body through said weakened end section so that the post passes between the inner dielectric material and the woven mesh shield; and applying a sufficient axial force to the body so that the weakened section is telescoped inside the main body section to radially compress the coaxial cable in tight frictional engagement between the post and the telescoped end section.

10. The method of claim 9 that includes the further step of rotatably mounting a threaded nut upon the extended end of the post.

11. The method of claim 10 that includes the further step of uniformly reducing the cross-sectional area of each tab from the tab root toward the main body section.

12. The method of claim 11 that includes the further step of providing the main body section with a first inside diameter that is greater than the second inside diameter of the weakened end section.

13. A compression connector for mounting upon the end of a coaxial cable that has a center conductor, inner layer of dielectric material, a woven mesh shield and an outer protective jacket, said connector including:

a body defining a cavity, said body having a weakened end section that is integrally joined to a main body section by a spaced apart tabs having cross sectional areas;

said main body section having a first inside diameter and the weakened section having a second inside diameter such that the first inside diameter is greater than the second inside diameter such that the weakened end section will telescope inside the main body section when an axial force is applied to the body;

a post mounted inside the body, said cavity post having a cross-section such that the post is able to pass between the dielectric layer and the woven mesh shield of a coaxial cable that is inserted into the body through the weakened end section; and said post being arranged to co-act with the telescoped weakened end section to radially compress the cable in tight frictional engagement between the post and the telescoped weakened end section when an axial force is exerted upon said body section.

14. The connector of claim 13 wherein the cross sectional area of said tabs is reduced from the root of the tab toward the main body section.

* * * * *

UNITED STATES PATENT AND TRADEMARK OFFICE

CERTIFICATE OF CORRECTION

PATENT NO. : 6,994,588 B2
APPLICATION NO. : 10/891818
DATED : February 7, 2006
INVENTOR(S) : Noah P. Montena It is certified that error appears in the above-identified patent and that said Letters Patent is hereby corrected as shown below:

Column 4 line 13 change “mounting off” to --mounting of--

Column 5 line 28 change numeral “60” to numeral --160--

Signed and Sealed this

Fifteenth Day of August, 2006

JON W. DUDAS
*Director of the United States Patent and Trademark Office*